US007490976B2

(12) United States Patent
Bucher

(10) Patent No.: US 7,490,976 B2
(45) Date of Patent: Feb. 17, 2009

(54) DISPOSABLE MIXER AND HOMOGENISER

(75) Inventor: Franz G. Bucher, Zug (CH)

(73) Assignee: Medic Tools AG, Zug (CH)

( * ) Notice: Subject to any disclaimer, the term of this patent is extended or adjusted under 35 U.S.C. 154(b) by 402 days.

(21) Appl. No.: 10/526,647

(22) PCT Filed: Oct. 15, 2003

(86) PCT No.: PCT/CH03/00675

§ 371 (c)(1),
(2), (4) Date: Mar. 3, 2005

(87) PCT Pub. No.: WO2004/035191

PCT Pub. Date: Apr. 29, 2004

(65) Prior Publication Data

US 2006/0013064 A1 Jan. 19, 2006

(30) Foreign Application Priority Data

Oct. 15, 2002 (CH) ..... 1722/02

(51) Int. Cl.
*B01F 7/16* (2006.01)

(52) U.S. Cl. ..... 366/247; 366/303; 241/243

(58) Field of Classification Search ..... 366/247, 366/253, 303, 249–251, 199; 241/243
See application file for complete search history.

(56) References Cited

U.S. PATENT DOCUMENTS 119,387 A * 9/1871 Montgomery ..... 366/253
3,060,702 A * 10/1962 Price ..... 62/392
3,704,864 A 12/1972 Lee
4,330,215 A * 5/1982 Gale ..... 366/99
4,976,547 A * 12/1990 Hisanaga et al. ..... 366/170.3
5,450,368 A * 9/1995 Kubota ..... 366/303
6,338,569 B1 * 1/2002 McGill ..... 366/144
6,447,158 B1 * 9/2002 Farkas ..... 366/316
6,916,114 B2 * 7/2005 Verkerk ..... 506/33

FOREIGN PATENT DOCUMENTS

DE 80 24 382.9 5/1988
DE 199 25 139 12/2000
JP 57 007 243 1/1982

* cited by examiner

*Primary Examiner*—David L Sorkin
(74) *Attorney, Agent, or Firm*—Volpe and Koenig, P.C.

(57) ABSTRACT

The invention relates to a device for the mixing, homogenizing, extraction, or slurrying of materials, in particular infectious, or malodorous or chemically-aggressive materials (71) in a laboratory test vessel (70) which may be hermetically sealed with a lid (10). A stirrer element (30) is provided in the lid (10) for processing of the material (71) placed in the laboratory test vessel (70), with the stirrer element being connected to a coupling piece (50). Cutting and/or crushing elements (31; 33, 35) arranged directly adjacent to cutting edges (42, 44; 41, 43, 45) on a retainer sleeve (40), comminute the material. The stirrer element (30) is a hollow cylinder (53) and is provided with a central sealing cap (32) such that the homogenate (71) can be manually or automatically diluted or pipetted from the laboratory test vessel (70) by means of a pipette or a needle or disposable tip without removing the disposable lid (10), or analyzed with a sensor or heated or cooled by means of a heating or cooling bar.

11 Claims, 6 Drawing Sheets

DISPOSABLE MIXER AND HOMOGENISER

BACKGROUND

The present invention relates to a device for mixing and homogenizing materials, in particular infectious or malodorous or chemically aggressive materials, in a laboratory test vessel.

Magnetic stirrers and mechanical stirrers are generally known and generally used in laboratories. During the comminution of infectious tissue fragments in vessels that are not hermetically sealed, there is a great risk of infection through uncontrolled spraying that can proceed outward through the opening of the laboratory test vessel, through accidental tipping over of the laboratory test vessel, and through the use of reusable mixers. This is the case particularly for test tubes and mixers known for use therewith.

SUMMARY

In view of this prior art, the objective of the present invention is to create a device of the above-noted type that allows a hermetic sealing of the laboratory test vessel and a complete mixing and homogenization of mixable materials and liquids, and allows a removal of the mixture and of the homogenate, or an addition of liquids, without removing the device.

This objective is achieved according to the present invention by a device having the features of Claim 1.

The operating safety is significantly increased for the user carrying out the processing due to the provision of the lid, with which, simultaneously, the laboratory test vessel is hermetically sealed and materials in the laboratory test vessel are processed, in particular mixed and homogenized.

In this way, infectious tissue fragments can also be handled safely. Due to the hermetic sealing of the laboratory test vessel, in this way a complete homogenization of the tissue fragments can safely be achieved. A membrane that can be pierced allows the homogenate or mixed material to be diluted or removed, using a pipette needle or a disposable tip, without removing the disposable lid from the laboratory test vessel, or allows this material to be analyzed using a sensor or to be tempered using a heating or cooling bar without requiring removal of the lid from the laboratory test vessel.

Advantageously, the lid is fashioned as a disposable lid, so that it is removed immediately after use, thus safely avoiding contamination during further work in the laboratory.

BRIEF DESCRIPTION OF THE DRAWINGS

In the following, the present invention is explained in more detail on the basis of various exemplary embodiments with reference to the attached drawings. Shown are.

DETAILED DESCRIPTION OF THE PREFERRED EMBODIMENTS

Figure 1:
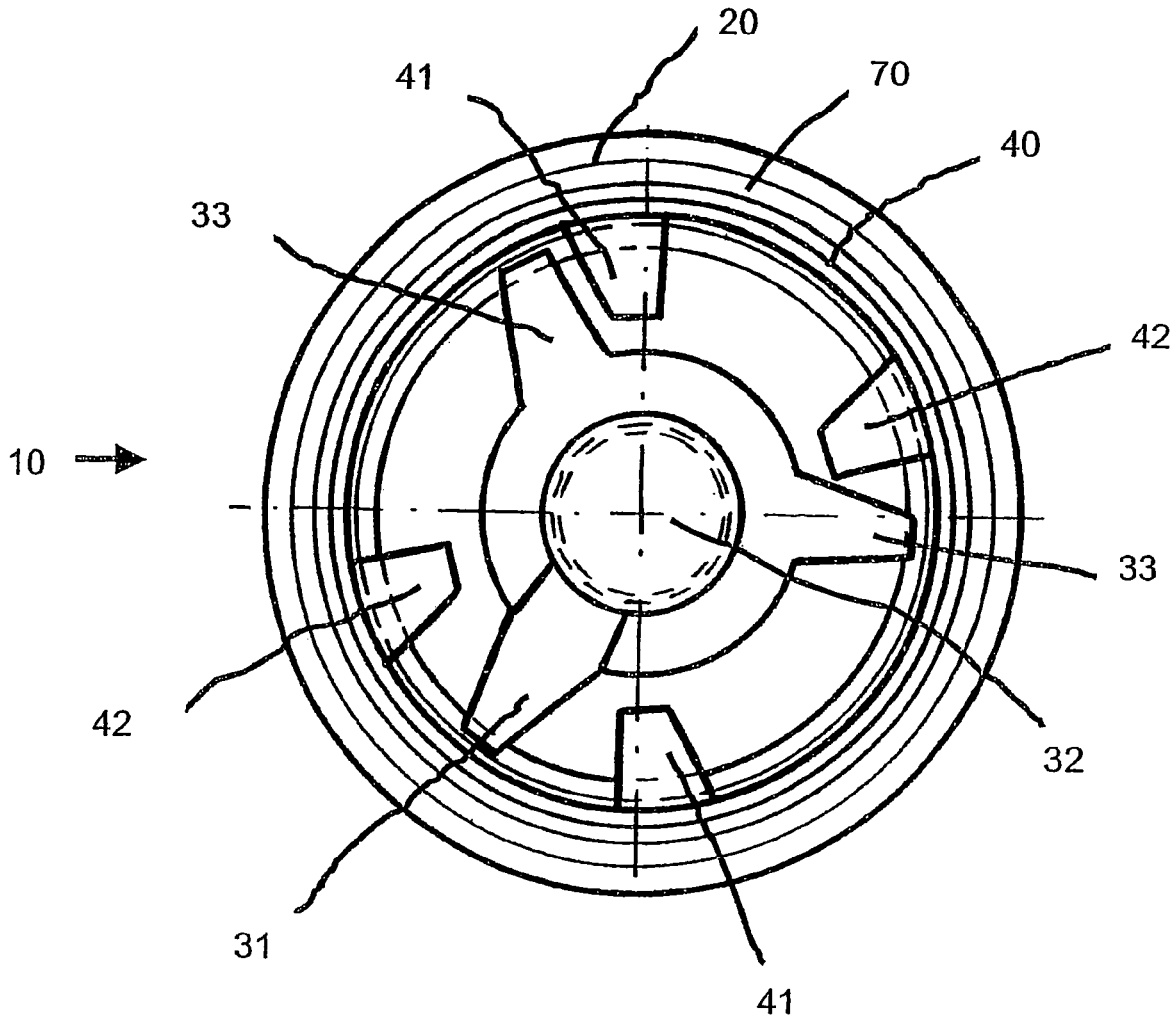
FIG. 1 is a schematic top view of the disposable lid.
Figure 9:
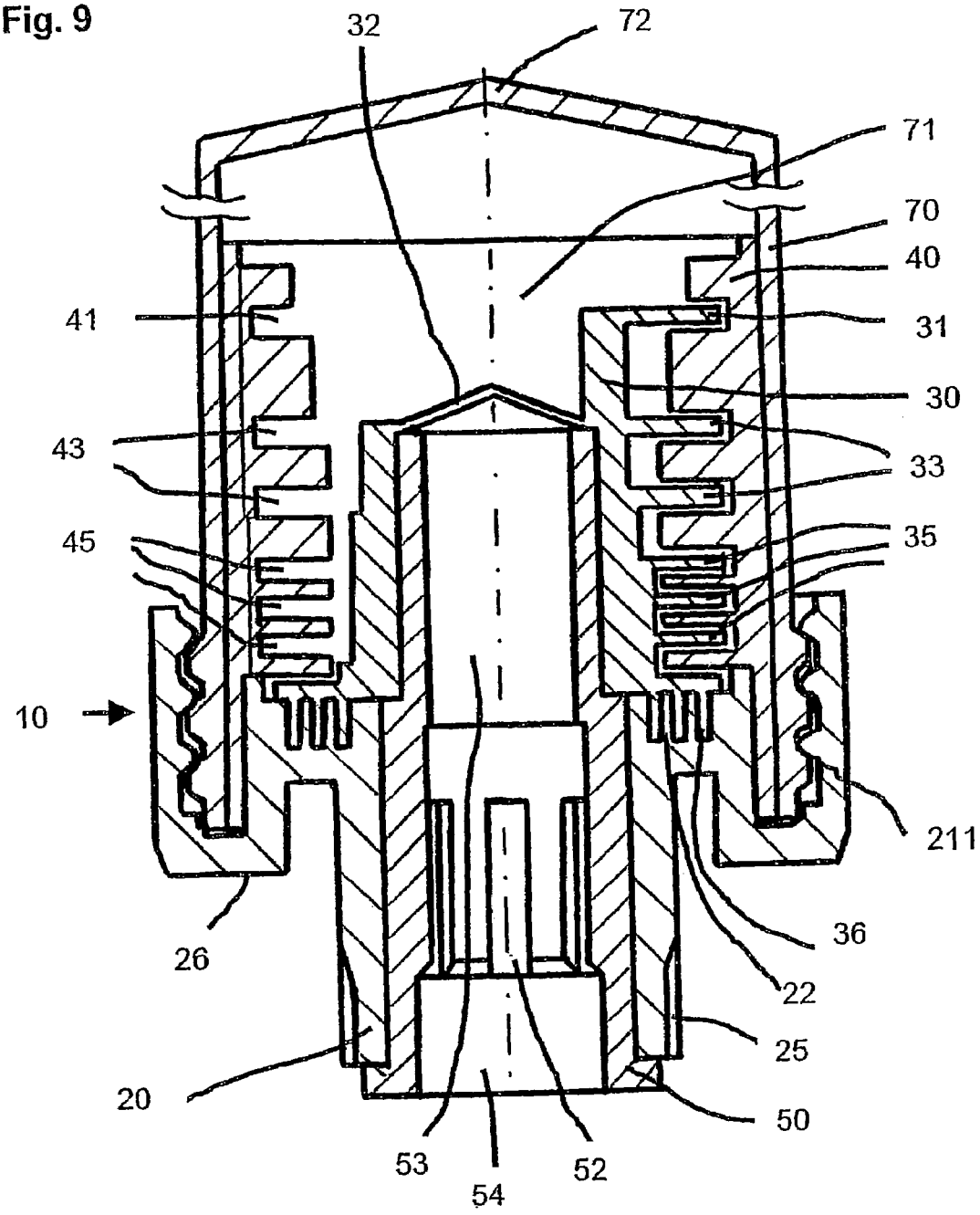
FIG. 9 is a schematic partly sectional side view of the disposable lid.

FIG. 1 shows a schematic top view and FIG. 9 shows a schematic, partly sectional side view of disposable lid 10. The interior of a cylindrical laboratory test vessel 70 having a conical tip 72 is filled with materials 71 that are to be mixed or homogenized. Subsequently, laboratory test vessel 70 is sealed with reusable screw lid 10 or with the reusable snap cap 10, and is then placed on the head.

In the reusable screw lid 10 or reusable snap cap 10 of hermetically sealable laboratory test vessel 70, there is provided a stirrer element 30 having a radial coarse cutting blade 31, three medium crushing pairs 33, and a triplet of fine crushing elements made of plastic or metal that are moved past the cutting edges of grooves 41, 43, 45 of retaining sleeve 40. With the aid of hollow axle 50, this stirrer element 30 is driven from outside laboratory test vessel 70 by an external six-point quick coupling bolt.

When laboratory test vessel 70 with the materials to be mixed and homogenized is situated on the head in the position according to FIG. 9, it is seated in non-positively locking fashion on the external six-point quick coupling bolt of an external drive. Through the communicated rotational motion, the materials and liquids 71 situated inside laboratory test vessel 70 are crushed, mixed, homogenized, and diverted upwards; these actions are carried out in three phases by rough cutting blade 31, the three medium crushing pairs 33, and the fine crushing triplet 35, against grooves 41, 43, 45 of retaining sleeve 40. Hydraulic labyrinth lip seal 22, 36, made up of three annular axial grooves and projections that intermesh, prevents liquid 71 from running out. The speed of rotation is determined specifically for the material being processed, in order to achieve optimal homogenization. The number of processing elements 31, 33, and 35 (1, 2, 3, etc.) can be selected freely; the person skilled in the art determines their number based on, among other factors, the constructive height and the type of blades selected.

Hydraulic labyrinth lip seal 22, 36 in lid 10 hermetically seals material 71 inside laboratory test vessel 70 from the surrounding environment, both in the idle state as well as during the rotational motion of stirrer element 30, thus preventing contaminating contact with the environment and the escaping of aerosols during and after the mixing or homogenizing.

Instead of using hydraulic labyrinth lip seal 22, 36 shown in the depicted exemplary embodiment, it is also possible to use a simple rubber seal, for example in the form of a sealing ring, or a different kind of standard sealing type known to those skilled in the art in order to seal laboratory test vessel 70 against the external environment.

Figure 2:
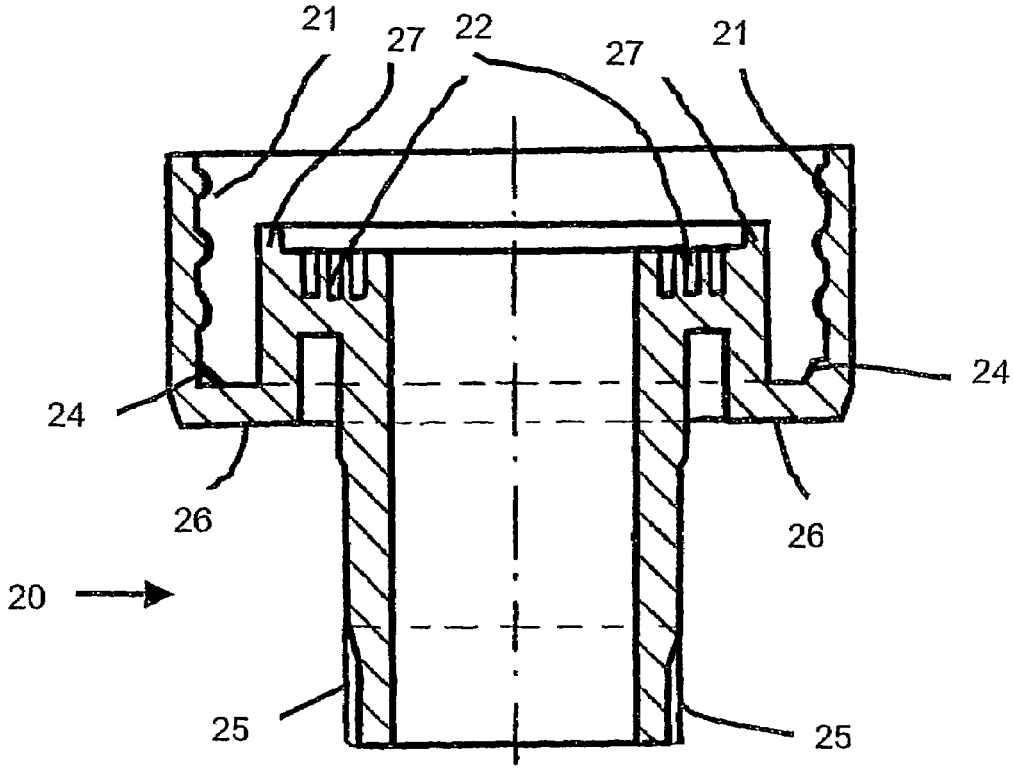
FIG. 2 is a schematic, partly sectional side view of the threaded element.

FIG. 2 shows a schematic, partly sectional side view of threaded element 20. The two-start thread 21 promotes easy accepting of laboratory test vessel 70. Sealing lip 24 provides additional security against the escaping of liquid 71. Twelve lateral grooves 25 prevent the threaded element from rotating concomitantly when hollow axle 50 is driven.

Figure 3:
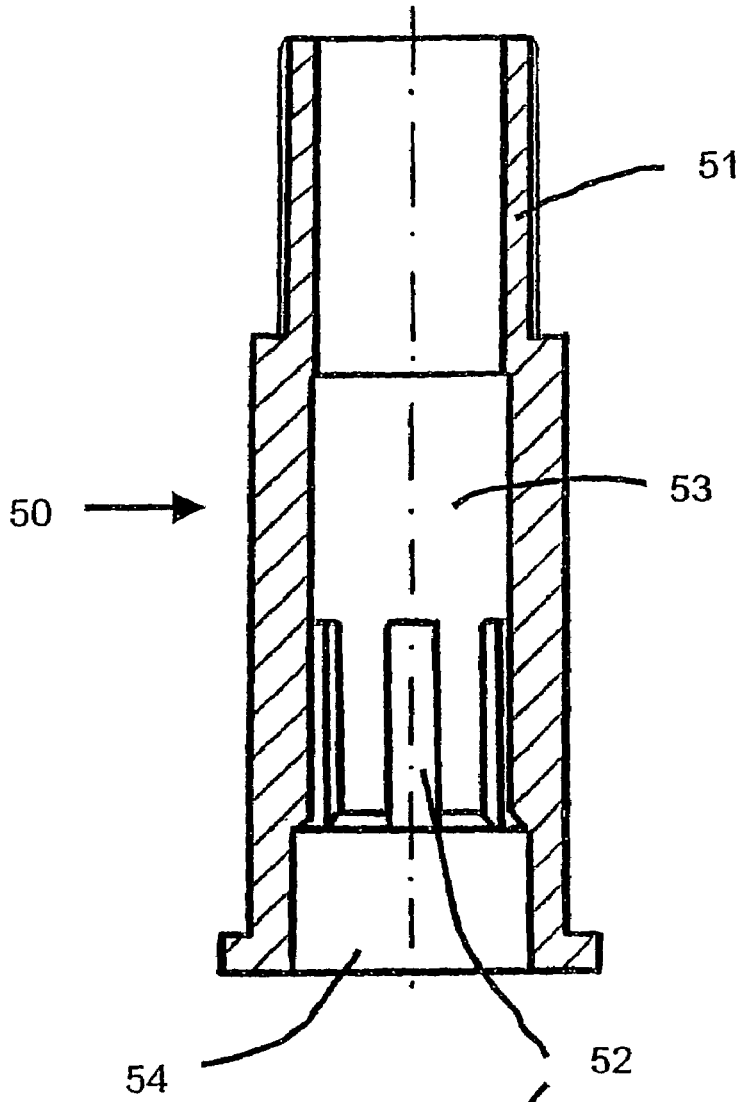
FIG. 3 is a schematic, partly sectional side view of the hollow axle.
Figure 4:
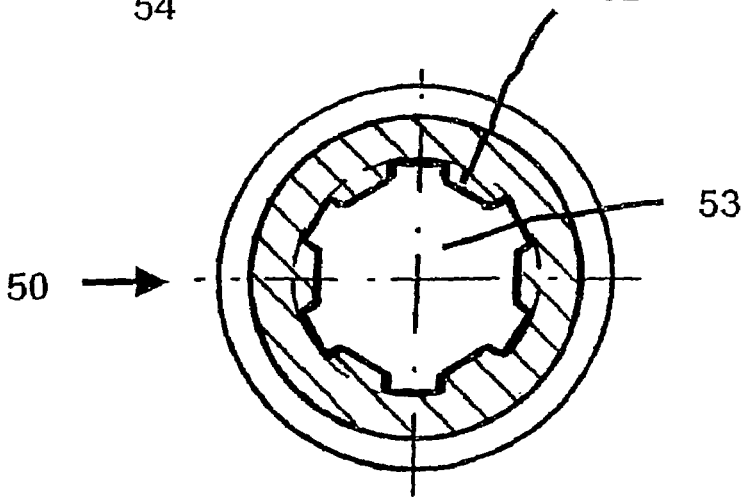
FIG. 4 is a schematic, partly sectional top view of the hollow axle.

FIG. 3 shows a schematic, partly sectional side view of hollow element 50, and FIG. 4 shows a schematic, partly sectional top view of hollow element 50. Six axial notches 52 receive the torque from the external six-point quick coupling bolt. The hollow element 50 is non-positively pressed into stirrer element 30.

Figure 5:
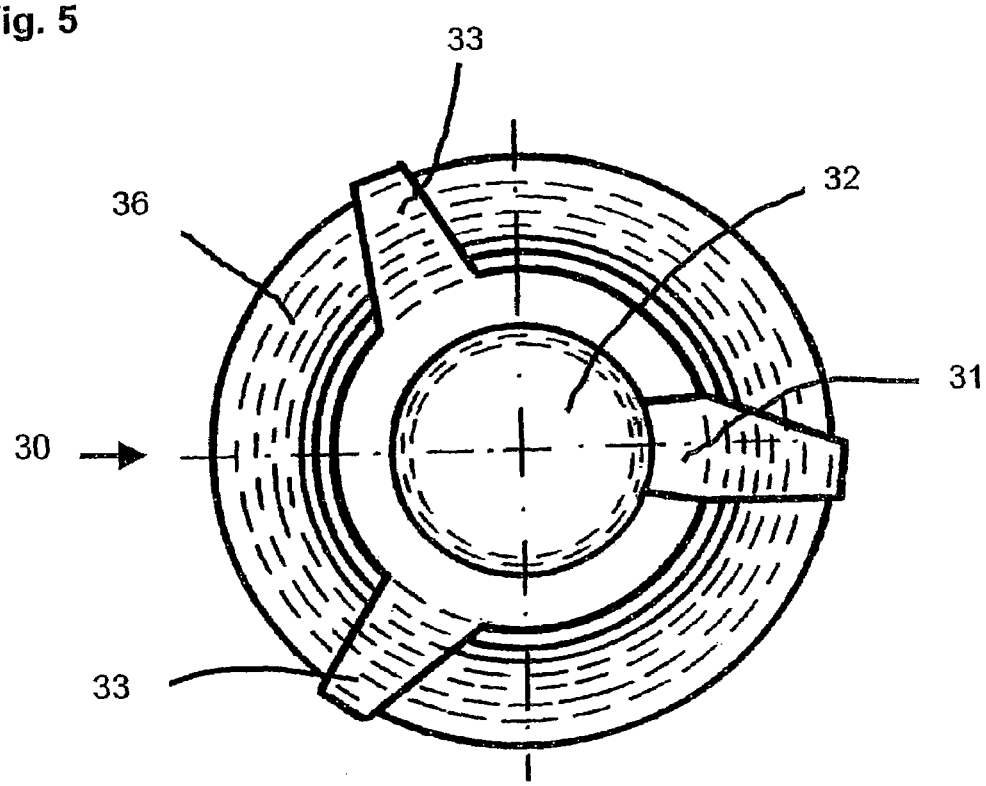
FIG. 5 is a schematic top view of the stirrer element with the cutting and crushing elements, the pierceable membrane, and a labyrinth type lip seal.
Figure 6:
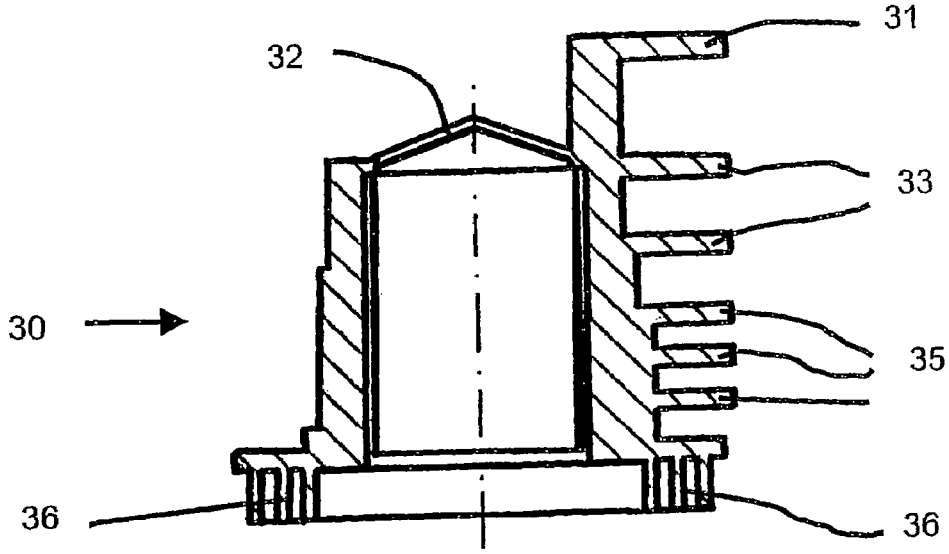
FIG. 6 is a schematic, partly sectional view of the stirrer element with the cutting and crushing elements, the pierceable membrane, and a labyrinth type lip seal.

FIG. 5 shows a schematic top view of stirrer element 30, and FIG. 6 shows a partly sectional view of stirrer element 30. When laboratory test vessel 70 is standing upright, membrane 32 enables a pipette needle, a disposable tip, a measurement sensor, or a heating/cooling component to be passed therethrough without having to remove disposable lid 10 from laboratory test vessel 70. This greatly minimizes possible contaminations and aerosols. After membrane 32 has been pierced, placing a snap lid into opening 54 (shown in FIG. 3) of hollow element 50 enables laboratory test vessel 70 to be hermetically resealed. Here, the central location for the introduction of the needle or hollow axis 53 is advantageous. This central location also permits the hermetic sealing, due to the fact that when membrane 32 is rotated, only small centrifugal forces, which could deform a lateral membrane and thus make it leak, act on this central part. If membrane 32 is pierced or broken through, it can also be provided that a snap lid made of plastic or metal hermetically reseals lid 10 in region 54.

Together with retainer sleeve 40, the stirrer element 30 enables homogenization in three phases. In the first phase, radial coarse cutting blade 31, working together with grooves 41 in retainer sleeve 40 in FIG. 8, cuts the material to be mixed into coarse fragments. In a second phase, the three radial medium crusher pairs 33 further comminute the material to be mixed with the aid of grooves 43. In the final phase, fine crushing triplet 35, together with grooves 45, homogenize the material to be mixed, forming the actual homogenate.

Figure 7:
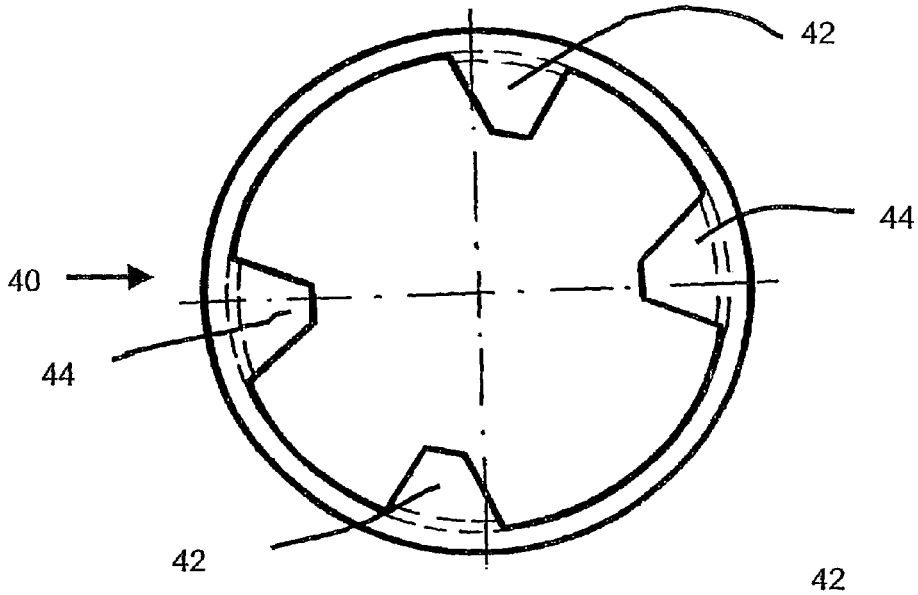
FIG. 7 is a schematic top view of the retainer sleeve with crushing grooves.
Figure 8:
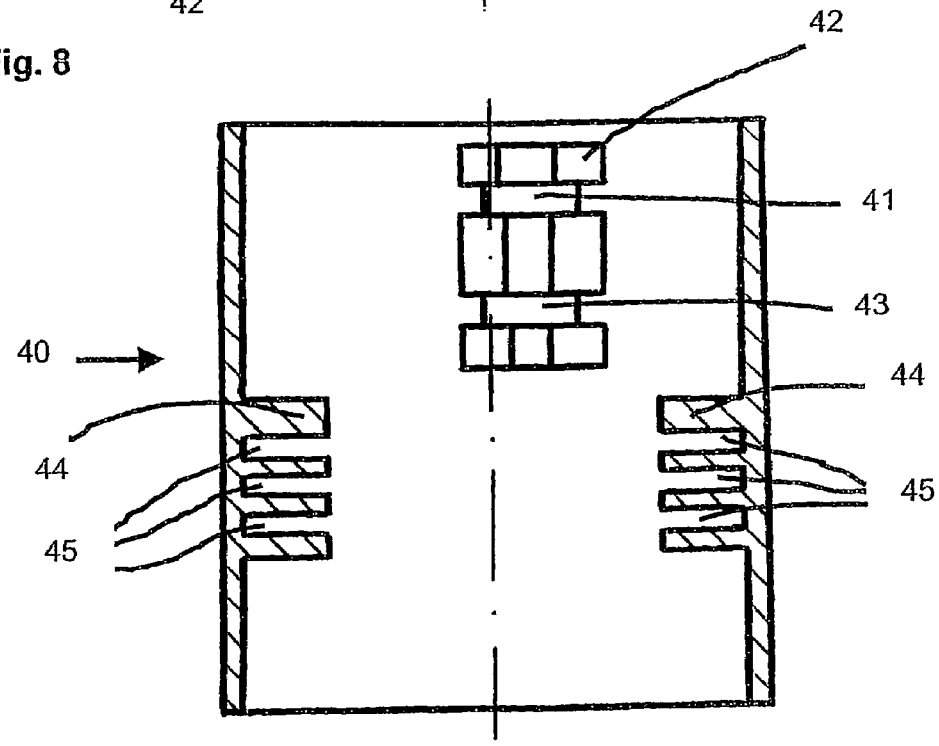
FIG. 8 is a schematic, partly sectional side view of the retainer sleeve with crushing grooves.

FIG. 7 shows a schematic top view of retainer sleeve 40, and FIG. 8 shows a partly sectional side view of retainer sleeve 40. Projection pairs 41 and 42 are radially and axially offset in a manner such that retainer sleeve 40 can at all times be placed into disposable lid 10 or removed from disposable lid 10. Grooves 41, 43, 45 in projections 42, 44, and grooves 42, 44 themselves, work to hold material being mixed 71 in laboratory test vessel 70 when it is placed on the head and stirrer element 30 is rotating, and to squeeze, cut, and crush this material. Through the removal of retainer sleeve 40 from disposable lid 10, the material being mixed 71 is mixed, extracted, or slurried in a more protected fashion when stirrer element 30 is rotating.

The following features that can be incorporated into the depicted specific embodiment of disposable lid 10 are not shown in the drawings. In FIG. 9, in area 29 sensor lines can be led through threaded element 20, these lines having electrical connections at the outward-directed side. In this way, during the mixing a sensor can easily be situated in area 27 of material 71 to be processed. Instead of sensor lines, a light waveguide can also be introduced, or a line can be introduced that forms a heating element or a Peltier element in area 27. Via heat-conducting drive axle 50, thermal energy can be introduced into laboratory test vessel 70, or can be conducted out of this vessel to the outside. In order to achieve a desired mixing or homogenization, a crucial role is played by the rotational speed profile of stirrer element 30 in test vessel 70, and by the duration of mixing. Via coupling element 50, all types of rotational speed accelerations and retardations, as well as ultrasound waves, can be supplied to stirrer element 30.

The invention claimed is:

1. Device for mixing, homogenizing, extracting, or slurrying materials in a laboratory test vessel (70), the device comprising a lid (10) with projections and a sealing lip to hermetically seal the laboratory test vessel, a stirrer element (30) being provided in the lid (10) for processing of the material (71) that can be placed into the laboratory test vessel (70), said stirrer element being connected to a coupling piece (50), and said stirrer element (30), which rotates about a longitudinal axis of the laboratory test vessel (70) being provided with cutting and/or crushing elements (31; 33, 35) situated directly adjacent to cutting edges (42, 44; 41, 43, 45) on a retainer sleeve (40), wherein the stirrer element (30) is a hollow cylinder (53) and is provided with a central sealing cap (32) that is a membrane that can be pierced or broken through.

2. Device according to claim 1, wherein the cutting and/or crushing elements include coarse cutting blades (31) and crushers (33, 35) that are situated directly adjacent to the cutting edges, which are formed by projections (42, 44) and grooves (41, 43, 45), the cutting and/or crushing elements being made of plastic or metal.

3. Device according to claim 1, wherein the retainer sleeve (40) is provided as an auxiliary element that has an inner opening and that can be pushed on or removed.

4. Device according to claim 1, wherein the lid is a disposable lid (10) and comprises a screw closure or a snap closure that is complementary to a corresponding element on the laboratory test vessel (70).

5. Device according to claim 1, further comprising a laboratory test vessel (70) that is cylindrical or parallelepiped in shape, and the laboratory test vessel (70) is made of plastic or glass.

6. Device according to claim 5, wherein when the laboratory test vessel (70) is standing upright, a homogenate therein can be analyzed or tempered manually or by machine through the membrane (32), which can be pierced or broken through, in the disposable lid (10) without having to remove the lid (10) from the laboratory test vessel (70).

7. Device according to claim 6, wherein the pierced or broken-through membrane (32) in the disposable lid (10) can be hermetically resealed in an area (54) using a snap lid made of plastic or metal.

8. Device according to claim 1, wherein the processing of the material (71) comprises crushing, mixing, homogenization, extraction, and slurrying.

9. Device according to claim 1, wherein the coupling piece (50) has a hollow construction and includes an inner six-point quick coupling ring (50), so that rotational energy can be supplied mechanically from outside.

10. Device according to claim 1, further comprising a heat-conducting drive axle in the lid the drive axle conducting thermal energy into the laboratory test vessel (70) or from the vessel to outside.

11. Device according to claim 1, wherein electrical lines or light waveguides are routed through an area (26) in the lid, to sensors or to heating or Peltier elements in an interior of the laboratory test vessel (70).

* * * * *